US006634731B2

(12) United States Patent
Kao et al.

(10) Patent No.: US 6,634,731 B2
(45) Date of Patent: Oct. 21, 2003

(54) PRINT HEAD APPARATUS CAPABLE OF TEMPERATURE SENSING

(75) Inventors: Chih-Hung Kao, Taipei (TW); Yu-Fan Fang, Taipei (TW)

(73) Assignee: Benq Corporation, Taoyuan (TW)

( * ) Notice: Subject to any disclaimer, the term of this patent is extended or adjusted under 35 U.S.C. 154(b) by 0 days.

(21) Appl. No.: 09/939,732

(22) Filed: Aug. 28, 2001

(65) Prior Publication Data

US 2002/0027574 A1 Mar. 7, 2002

(30) Foreign Application Priority Data

Aug. 29, 2000 (TW) ..... 89117550 A

(51) Int. Cl.[7] ..... B41J 29/38

(52) U.S. Cl. ..... 347/14; 347/17; 347/60; 347/185

(58) Field of Search ..... 347/14, 17, 57, 347/58, 59, 60, 19, 185, 211

(56) References Cited

U.S. PATENT DOCUMENTS

| | | | | | |
|---|---|---|---|---|---|
| 4,719,472 | A | * | 1/1988 | Arakawa | 346/140 |
| 4,947,194 | A | * | 8/1990 | Kyoshima | 346/140 |
| 5,182,580 | A | | 1/1993 | Ikeda et al. | 347/19 |
| 5,517,224 | A | * | 5/1996 | Kaizu et al. | 347/59 |
| 5,541,629 | A | * | 7/1996 | Saunders et al. | 347/12 |
| 5,975,669 | A | * | 11/1999 | Ohshima | 347/14 |
| 6,231,153 | B1 | * | 5/2001 | Elgee | 347/17 |
| 6,305,776 | B1 | * | 10/2001 | Ohshima et al. | 347/17 |
| 6,389,241 | B1 | * | 5/2002 | Cernusak et al. | 399/44 |

FOREIGN PATENT DOCUMENTS

CN 1309020 A 8/2001

OTHER PUBLICATIONS

Sautter/Weinerth, "Lexikon Elektronik und Mikroelektronik", 2ed. 1993, pp. 492, 697–699, 994, 995, 1052–1055, 1062, 1063 (*English translation for selected paragraphs*).

* cited by examiner

*Primary Examiner*—Judy Nguyen
*Assistant Examiner*—Lam Nguyen
(74) *Attorney, Agent, or Firm*—Rabin & Berdo, P.C.

(57) ABSTRACT

A print head apparatus capable of temperature sensing is provided. The print head apparatus includes an ink ejector coupled to an enabling signal and a selection signal for selecting the ink ejector. The ink ejector includes a nozzle, a heating module for selectively heating ink in the ink ejector so that ink droplets are ejected from the nozzle, and a temperature sensing module for selectively producing a measured temperature signal indicative of a temperature of the ink in close proximity to the nozzle. When the enabling signal is active, and the selection signal is active and indicates that the ink ejector is selected, the heating module heats up the ink in the ink ejector so that the ink droplets are ejected from the nozzle. When the selection signal is active and indicates that the ink ejector is selected, the temperature sensing module outputs the measured temperature signal indicative of the temperature of the ink in close proximity to the nozzle. By applying the invention to an inkjet print head with a plurality of nozzles, the temperature of each nozzle can be obtained selectively.

29 Claims, 9 Drawing Sheets

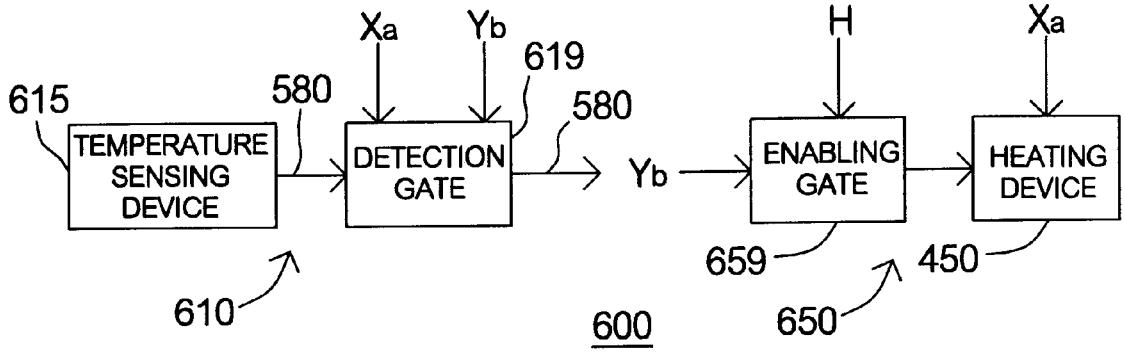
FIG. 7
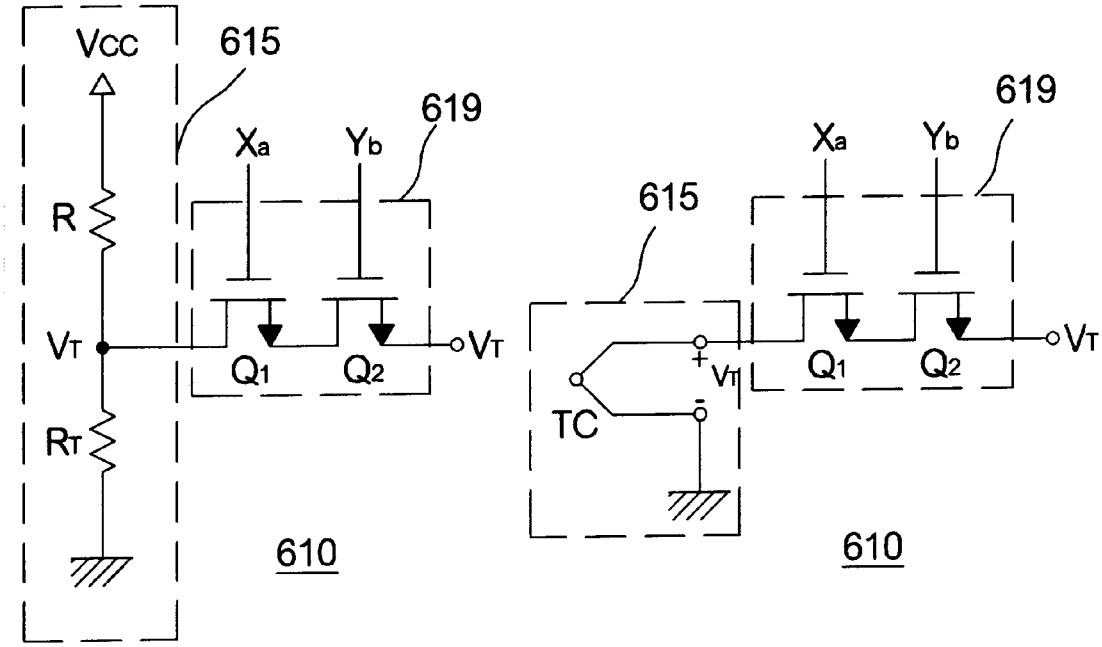
FIG. 8A
FIG. 8B

PRINT HEAD APPARATUS CAPABLE OF TEMPERATURE SENSING

This application incorporates by reference Taiwanese application Serial No. 89117550, filed on Aug. 29, 2001.

BACKGROUND OF THE INVENTION

1. Field of the Invention

The invention relates in general to an apparatus for temperature sensing and heating, and more particularly to an apparatus for temperature sensing and heating for use in a print head.

2. Description of the Related Art

Over the years, electronic related industries progress as the technology advances. For various electronic products, such as computer systems, computer peripherals, appliances and office machines, their functions and appearances are improved greatly as well. For example, in the 1980s, impact-type dot matrix printers and monochrome laser printers were pre-dominant. Later in the 1990s, monochrome inkjet printers and color inkjet printers became popular for common uses while color laser printers were available for professional uses. For common end users who do not print documents frequently, they would probably select color inkjet printers after considering the printing quality and price. People with sufficient budgets would probably purchase a monochrome laser printer. Since the price and quality are critical to the users' choices, printer vendors aggressively develop their products so that the products have lower cost and better quality so as to increase popularity and profits of their products. Therefore, developers are focusing on how to improve the performance of products under limited cost.

Most inkjet printers now use bubble inkjet print head or piezo-electrical inkjet print head to spray ink droplets onto a sheet of medium, such as paper, for printing. The bubble inkjet print head includes a heating device, ink, and nozzles. The heating device is to heat the ink to create bubbles until the bubbles expand enough to burst so that ink droplets are fired onto the sheet of paper through the nozzles, forming dots on the sheet of paper. Varying the concentration and locations of the droplets can form wide range of different texts and graphics on the paper.

The quality of printing is closely related to the resolution provided by the printers. Currently, entry-level color printers provide a maximum resolution of 720 by 720 dot per inch (dpi) or 1440 by 720 dpi. Higher resolution requires finer size of the droplets. The size of the droplets is related to the cohesion of the droplets. For instance, for droplets having identical amount of ink, those droplets with greater cohesion may have a smaller range of spread when they fall onto the paper, resulting in clearer and sharper printing quality. On the other hand, those droplets with smaller cohesion may have a greater range of spread when they fall onto the paper, resulting in a poorer printing quality. Thus, cohesion of the droplets affects the printing quality. In common bubble inkjet printing technique, if it is required to eject ink droplets by a specific nozzle, the heating device associated with the nozzle is first enabled to heat the ink so as to generate bubbles in the chamber associated with the nozzle. The viscosity of the ink decreases as the temperature of the ink rises. If the heating process is not well controlled and the ink is overheated, the viscosity of the ink becomes lower than a normal level and the cohesion of the droplets is reduced, resulting in a degraded printing quality. In addition, if the chamber contains insufficient ink or the ink droplet is not fired properly, the temperature of the ink in the chamber will exceed the normal level, resulting in the viscosity of the ink being lower than the normal. In addition, if a nozzle is frequently fired, the ink in the chamber associated with the nozzle will have higher temperature and lower viscosity than the ink in the chamber associated with other nozzles. All these conditions cause the viscosity of the ink to be unstable, and thus affecting the printing quality. Therefore, accurately monitoring and controlling the temperature of the ink in the chamber is the key to the improvement in the ink jet printing quality.

FIG. 1A is a block diagram illustrating the conventional control of an inkjet printer. The inkjet printer 10 includes a driving module 11 and a print head module 15. The driving module 11 includes a controller 12 and a driver circuit 13. The print head module 15 includes an array of inkjet ejector 16 and a temperature sensing device 17. For the printing of data onto a sheet of paper, the controller 12, in response to the data, drives the driver circuit 13 so that the driver circuit 13 sends selection signals 14 to the array of inkjet ejectors 16. In the array of inkjet ejectors 16, selected heating devices such as a heating device 19 shown in FIG. 1B heat up according to selection signals 14 so that ink droplets are ejected onto the paper through the nozzles of the array of inkjet ejectors 16. FIG. 1B is a sectional view illustrating the array of inkjet ejectors 16 shown in FIG. 1A along with the heating device 19 and a nozzle 18. The heating device 19 is mounted in close proximity to the nozzle 18, and is used for heating the ink in the chamber 21 in order to create a bubble 20. The ink in the chamber 21 is heating up until the pressure in the chamber 21 forces the bubble 20 to burst and a droplet of ink is ejected from the nozzle 18. The ejected ink droplet then forms a spot on the sheet of paper.

Further, in order to monitor the temperature of the nozzles, a temperature sensing device 17, such as a thermal resistor, is arranged near a portion of nozzles of the array of inkjet ejectors 16. The measured temperature data from the temperature sensing device 17 is fed back to the controller 12 for the control of the temperature.

In the following, it is to describe how to select heating devices according to selection signals 14 so that ink droplets are ejected from the nozzles. FIG. 2 is a circuit diagram illustrating the array of inkjet ejectors 16 in FIG. 1A. The array of inkjet ejectors 16 includes an M×N two-dimensional array of circuit elements. Each of the circuit elements is formed by a resistor R coupled with a transistor Q, and is associated with one of the nozzles. Besides, the selection signals 14 are selectively applied to the circuit units to create bubbles and cause ink droplets to be ejected for the formation of marks on the sheet of paper. When one of the selection signals 14 is selectively applied to the circuit element to cause the transistor Q conduct, the resistor R generates heat for the ink of the chamber 21 to cause a ink droplet to be ejected from the nozzle 18. In other words, the resistor R is used as the heating device for heating the ink of the chamber. In addition, for the reduction of the number of signals, the selection signals can be composed of row signals and column signals. In FIG. 2, $X_a$ denotes one row signal of the selection signals 14 while $Y_b$ denotes one column signals of the selection signals 14, where a=1, 2, . . . , M and b=1, 2, . . . , N. For the sake of brevity, this notation will be used in the following of the specification. For instance, when the row signal $X_1$ and column signal $Y_1$ are active and fed to the array of ink ejectors 16, the transistor $Q_{11}$ conducts and thus the resistor $R_{11}$ produces heat so that a droplet of ink is ejected from the associated nozzle. Likewise, when the row signal $X_M$ and column signal $Y_N$ are active and fed to the array of ink ejectors 16, the transistor $Q_{MN}$ conducts and thus the resistor $R_{MN}$ produces heat so that a droplet of ink is ejected from the associated nozzle. In this way, according to the row and column signals of selection signals 14, the nozzles indicated by selection signals 14 can be accurately enabled for printing.

FIG. 3 are comparative graphs of measured temperature of the nozzles in the same structure as in FIG. 1B versus the time as the nozzles are in a normal case and in an abnormal case. In the normal case, the temperature of the nozzles increases as the ink is being heated and then it reduces after the ejection of ink occurs. The temperature variation in the normal case can be represented by the curve denoted as "normal nozzle". In the abnormal case, such as the blockage in some nozzles, the ink droplets cannot be produced and the heat cannot dissipate, resulting in a small reduction of the temperature of the nozzles. The temperature variation in this abnormal case can be represented by the curve denoted as "abnormal nozzle".

In the conventional print head module 15 shown in FIG. 1, the temperature of the nozzles is obtained from the temperature sensing device 17 which is formed by a thermal resistor arranged near some of the nozzles. In addition, the temperature of the nozzles is determined by the variation of the resistance of the thermal resistor.

However, the temperature obtained in this way is an average temperature of some or all of the nozzles whereas the change of the temperature of one of the nozzles is unobtainable. Therefore, if the temperature of one or a small number of nozzles increases abnormally, the temperature sensing device 17 of the conventional print head module 15 cannot determine which nozzle has an abnormal increase in temperature and the temperature compensation for this abnormal increase in temperature may be inadequate.

SUMMARY OF THE INVENTION

It is therefore an object of the invention to provide a print head apparatus capable of sensing the temperature of nozzles selectively.

It is another object of the invention to provide a print head apparatus capable of sensing the temperature of nozzles selectively or heating the nozzles selectively, which can be applied to the design of a system without the substantial changes in the design.

According to the objects of the invention, it provides a print head apparatus capable of temperature sensing. The print head apparatus includes an ink ejector coupled to an enabling signal and a selection signal for selecting the ink ejector. The ink ejector includes a nozzle, a heating module for selectively heating ink in the ink ejector so that ink droplets are ejected from the nozzle, and a temperature sensing module for selectively producing a measured temperature signal indicative of a temperature of the ink in close proximity to the nozzle. The heating module includes a heating device and an enabling gate. The heating device is coupled to the enabling gate and is disposed in close proximity to the nozzle for heating up the ink in the ink ejector in order to eject ink droplets from the nozzle. The enabling gate is coupled to the enabling signal and is used to cause the heating device to heat up. The temperature sensing module includes a temperature sensor and a detection gate. The temperature sensor is disposed in close proximity to the nozzle and coupled to the detection gate, and is used for measuring the temperature of the ink in close proximity to the nozzle and producing the measured temperature signal indicative of the temperature of the ink in close proximity to the nozzle. The detection gate is coupled to the selection signal, and is used for selectively outputting the measured temperature signal. When the selection signal is active and indicates that the ink ejector is selected, the temperature sensing module outputs the measured temperature signal indicative of the temperature of the ink in close proximity to the nozzle.

Other objects, features, and advantages of the invention will become apparent from the following detailed description of the preferred but non-limiting embodiments with reference to the accompanying drawings.

BRIEF DESCRIPTION OF THE DRAWINGS

FIG. 7 is a block diagram illustrating the ink ejector circuit in FIG. 6.

FIG. 8A is a circuit diagram of an example of the temperature sensing module in FIG. 6.

FIG. 8B is a circuit diagram of another example of the temperature sensing module in FIG. 6.

DESCRIPTION OF THE PREFERRED EMBODIMENT

Figure 1A:
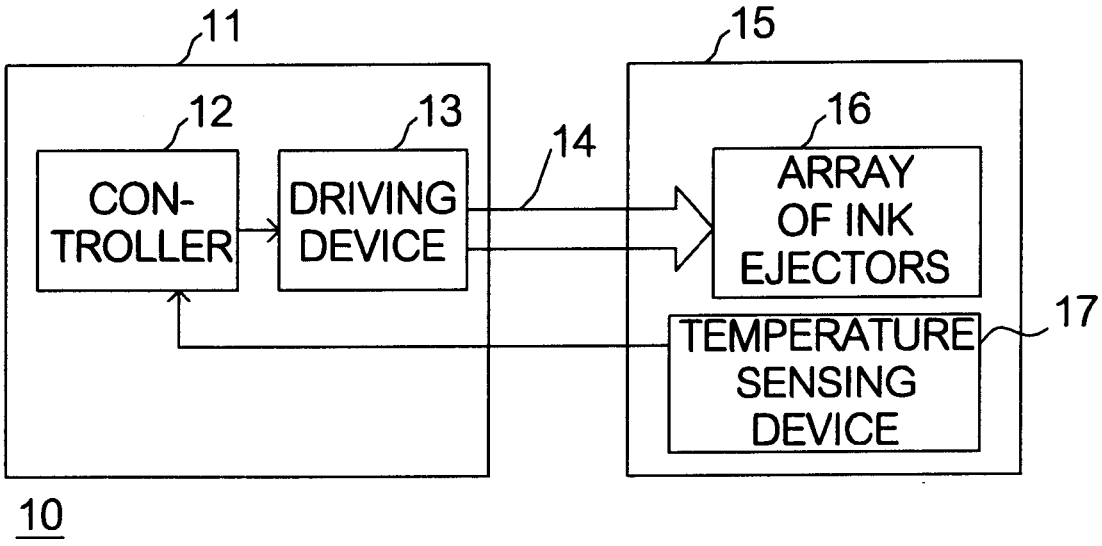
FIG. 1A(PRIOR ART)
FIG. 1A (Prior Art) is a block diagram illustrating the conventional control of an inkjet printer.
Figure 1B:
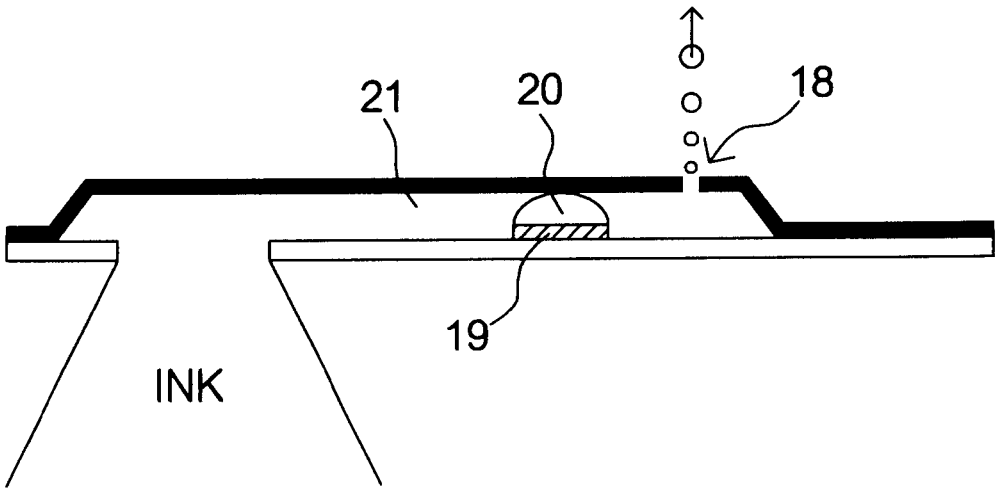
FIG. 1B(PRIOR ART)
FIG. 1B (Prior Art) is a sectional view illustrating the array of inkjet ejectors in FIG. 1A.
Figure 2:
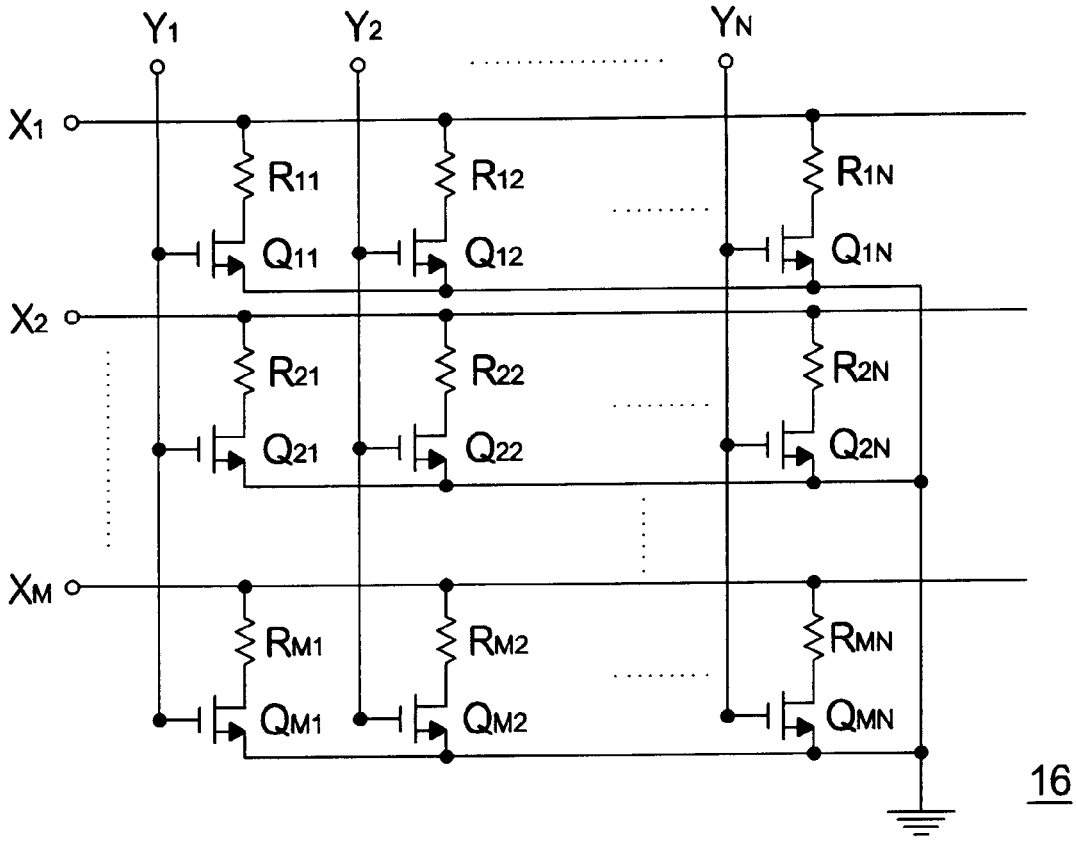
FIG. 2(PRIOR ART)
FIG. 2 (Prior Art) is a circuit diagram illustrating the array of inkjet ejectors in FIG. 1A.
Figure 3:
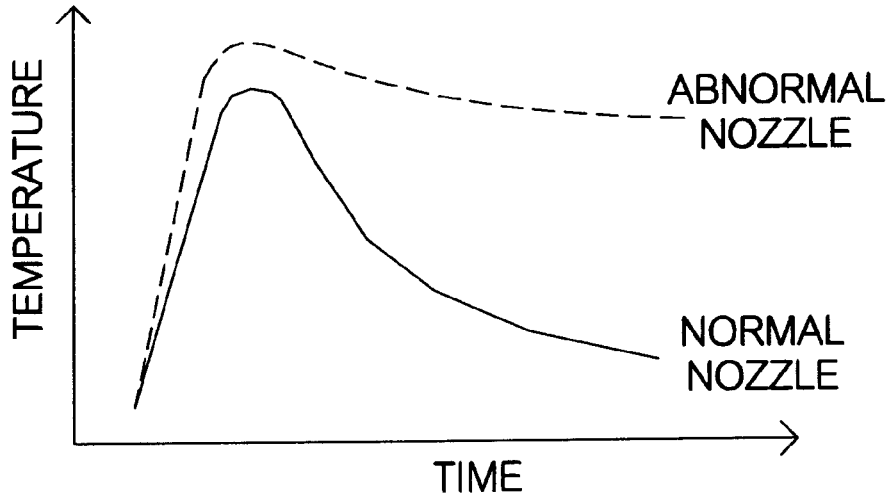
FIG. 3(PRIOR ART)
FIG. 3 (Prior Art) are comparative graphs of measured temperatures of the nozzles in the same structure as in FIG. 1B versus the time as the nozzles are in a normal case and in an abnormal case.
Figure 4:
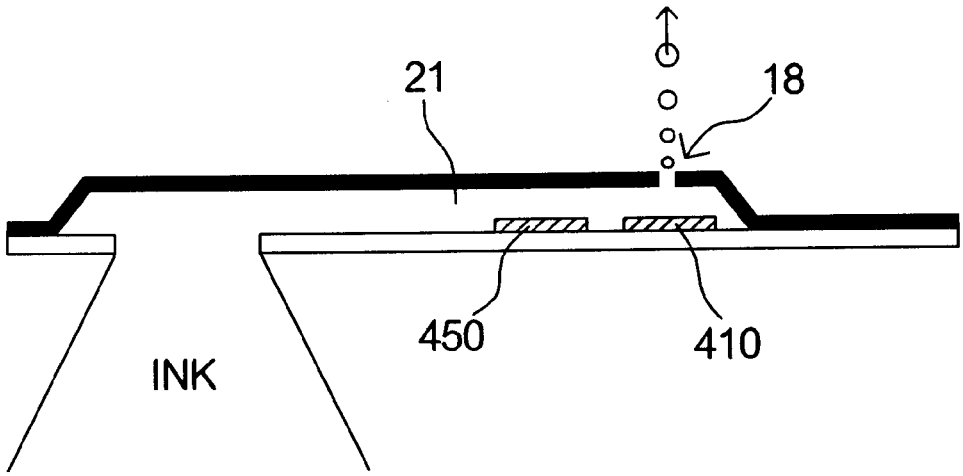
FIG. 4 is a sectional view illustrating a structure of an ink ejector according to a preferred embodiment of the invention.

FIG. 4 shows a structure of an ink ejector in a sectional view according to a preferred embodiment of the invention. The ink ejector includes a nozzle 18, a heating device 450, and a temperature sensor 410. The heating device 450 and the temperature sensor 410 are disposed in close proximity to the nozzle 18. The heating device 450 is used for heating the ink contained in the ink ejector so as to create bubbles and jet ink droplets from the nozzle 18. For instance, the heating device 450 can be a resistor or other device for heating the ink. The temperature sensor 410 is used for sensing the temperature of the nozzle 18 so as to produce a measured temperature signal indicating the temperature of the nozzle 18. For instance, the temperature sensor 410 can be a thermal resistor or other device for sensing the temperature of the nozzle 18. Thus, the temperature of the nozzle 18 can be obtained via the measured temperature signal. Further, the temperature of each nozzle can be obtained accordingly when the identical structure is applied to all ink ejectors on the ink jet print head.

Figure 5:
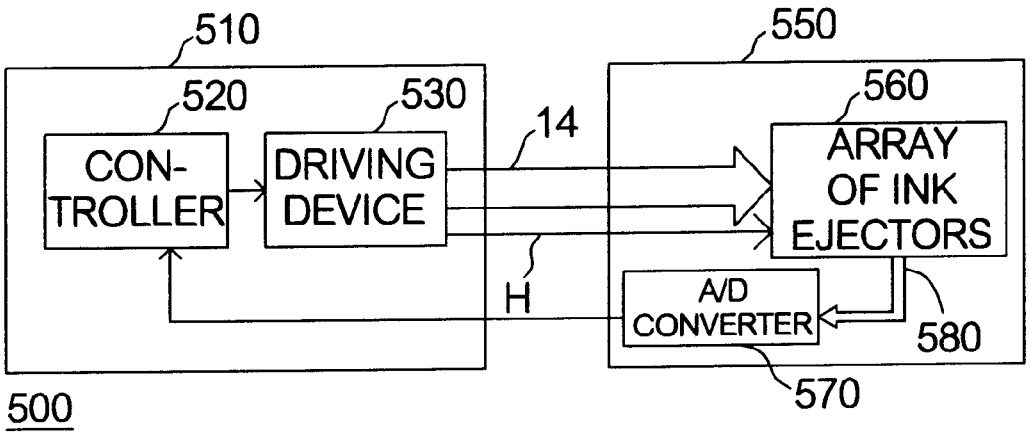
FIG. 5 is a block diagram illustrating the control of an inkjet printer according to the invention.

FIG. 5 shows a block diagram illustrating the control of an inkjet printer according to the invention. The inkjet printer 500 includes a driving module 510 and a print head apparatus 550. The driving module 510 includes a controller 520 and a driving device 530, and the driving device 530 is capable of applying a selection signal 14 and an enabling signal H to the print head apparatus 550. The print head apparatus 550 includes a plurality of ink ejectors which may be arranged in an array form, such as an array of ink ejectors 560. The array of ink ejectors 560 is coupled to the selection signal 14 and the enabling signal H. In addition, each ink ejector 560 includes a nozzle 18, a heating module for selectively heating the ink contained in the ink ejector so as to jet ink droplets from the nozzle, and a temperature sensing module for selectively outputting a measured temperature signal indicative of the temperature of the ink close to the nozzle.

When it is required to measure the temperature of the ink close to a nozzle, the driving device 530 feeds the selection signal 14 into the array of ink ejectors 560 in order to select one of the ink ejectors. For selecting at least one of the array of ink ejector 560, the selection signal 14 includes a row and column selection signals for indicating that one ink ejector coupled to the row and column selection signals $X_a$ and $Y_b$. In response to the selection signal 14, one of the ink ejectors that is selected by the row and column selection signals $X_a$ and $Y_b$ outputs a measured temperature signal indicative of the temperature of the ink close to the nozzle.

When the measured temperature signal 580 is outputted from the ink ejector 560, it is fed into an analog-to-digital (A/D) converter 570 where it is converted into a digital signal representative of the measured temperature. The digital signal is fed back to the controller 520 so that the controller 520 is informed of the temperature information of the ink ejectors 560 and may take further action to control the ink ejectors 560 according to the temperature information.

In addition, the selection signal 14 can include one or more pairs of row and column selection signals for selecting one or more ink ejectors of the array of ink ejectors 560. Thus, in response to the selection signal 14, the array of ink ejectors 560 can output a plurality of measured temperature signals indicating the temperature of the nozzles if part or all of the ink ejectors 560 are selected. Similarly, the measured temperature signals can be fed into the A/D converter 570 and then fed back to the controller 520 so that the controller 520 is informed of the temperature information of the ink ejector 560 and may take further action to control the ink ejectors 560, such as accurate temperature control, according to the temperature information.

When the controller 520 desires printing and selects a number of ink ejectors 560 to jet ink droplets, the selection signals 14 and the enabling signals H are set to be active and fed into the array of the ink ejectors 560. After the selected ink ejectors receive both the selection signals 14 and the enabling signals H, the selected ink ejectors will jet ink droplets. When the controller 520 desires sensing the temperature of the ink ejectors 560, only the selection signals 14 will be active and fed into the array of ink ejectors 560. The controller 520 will retrieve the measured temperature signals 580 of the selected ink ejectors. In other words, the enabling signal H is used to indicate that the ink ejectors indicated by the selection signal 14 are selected to heat up the ink close to the nozzle. If the enabling signal H is not active and fed into the array of ink ejectors 560, the measured temperature signal 580 of the ink close to the nozzle indicated by the selection signal 14 will be retrieved. If both the selection signal 14 and the enabling signal H are active and fed into the array of ink ejectors 560, ejection of ink droplets from the nozzle indicated by the selection signal 14 will be performed. In this manner, it can avoid erroneously driving the heating module when temperature measurement is being performed.

There are two types of signal representations of the selection signal and thus two different design approaches are proposed. (1) In the first approach, the array of ink ejectors 560 is formed with a two-dimensional array of circuit elements. The ink ejector is selected by a selection signal in the form of rows and columns. This approach requires a reduced set of signals and a simplified circuitry, and is thus more popular. (2) In the second approach, each ink ejector is selected by a dedicated selection signal. This approach requires more signals than the first one, and results in a more complex circuitry. Thus, it is less common now. Since the structure according to the invention can apply to either one of the two design approaches, two examples will be described in the following.

EXAMPLE I

Figure 6:
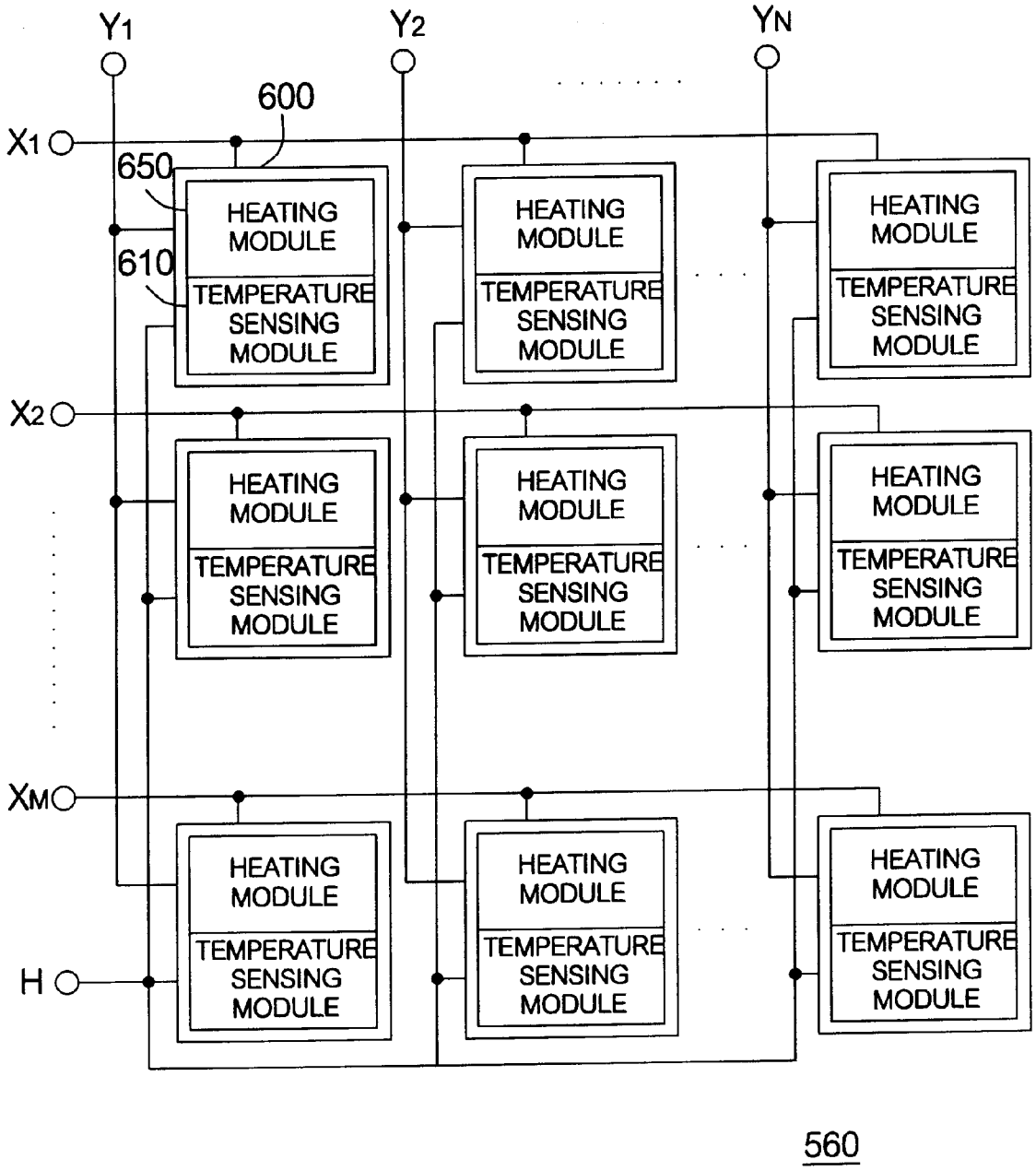
FIG. 6 is a circuit diagram illustrating the array of ink ejectors in FIG. 5.

Referring to FIG. 6, it shows a circuit diagram illustrating the array of ink ejectors 560 in FIG. 5. The array of ink ejectors 560 is an M×N two-dimensional circuit array formed by M×N ink ejector circuits 600, which are also capable of temperature sensing. Each ink ejector circuit 600, which is capable of temperature sensing, is disposed in close proximity to an associated nozzle and coupled to associated row and column selection signals $X_a$ and $Y_b$. In addition, each ink ejector circuit 600 is coupled to the enabling signal H. For the sake of brevity, the details of the signal coupling are not shown in FIG. 6. The details will be described as follows.

FIG. 7 shows a block diagram illustrating one of the ink ejector circuits 600 in FIG. 6. The ink ejector circuit 600 includes a temperature sensing module 610 and a heating module 650. Both the temperature sensing module 610 and the heating module 650 are coupled to the row and column selection signals $X_a$ and $Y_b$, wherein only the heating module 650 is further coupled to the enabling signal H. By the enabling signal H, the heating module 650 can be disabled while temperature sensing is performed, and thus erroneously printing can be avoided.

In the following, the operation of the temperature sensing module 610 is first described. Turning now to FIG. 8A, it shows a circuit diagram of the temperature sensing module 610 in FIG. 6. The temperature sensing module 610 includes a temperature sensing device 615 and a detection gate 619. The temperature sensing device 615 is used for measuring the temperature of the ink close to nozzle 18 so as to produce a measured temperature signal 580, indicative of the temperature of the ink close to nozzle 18. The detection gate 619 is used for selectively outputting the measured temperature signal 580 according to the selection signal 14. The temperature sensing device 615, which a voltage source $V_{CC}$ is applied to, includes a resistors R and $R_T$. It should be noted that the resistor R is of fixed resistance, the resistor $R_T$ is a resistor whose resistance varies with the temperature, such as a thermal resistor or thermistor. In practice, a thermistor acts as the resistor $R_T$, and can be disposed near the nozzle 18 for use as the temperature sensor 410 in FIG. 4. When the temperature of the ink close to the nozzle 18 increases, the resistance of the thermistor reduces and thus the voltage $V_T$ across the resistor $R_T$ reduces. Conversely, when the temperature of the nozzle 18 decreases, the resistance of the thermistor increases and thus the voltage $V_T$ across the resistor $R_T$ increases. Therefore, the voltage $V_T$ can be regarded as the measured temperature signal 580. Accordingly, the measured temperature signal 580 is produced according to the temperature of the nozzle.

In addition, transistors $Q_1$ and $Q_2$ are coupled together, forming the detection gate 619 for selectively outputting the measured temperature signal 580. In practice, the transistors $Q_1$ and $Q_2$ can be coupled with the row selection signal $X_a$ and the column selection signal $X_b$ respectively. As can be seen from FIG. 8A, when both the row and column selection signals $X_a$ and $Y_b$ are active and fed into the detection gate 619, the measured temperature signal 580 will be outputted by the detection gate 619. Thus, when it is required to obtain the temperature of a nozzle, the row and column selection signals $X_a$ and $Y_b$ associated with the nozzle are active and fed into the detection gate 619 to turn on the detection gate 619 and the measured temperature signal 580 is then outputted for the measurement of the temperature of the nozzle.

Referring to FIG. 8B, it shows a circuit diagram of another example of the temperature sensing module in FIG. 6, wherein the temperature sensing device 615 is implemented by using a thermocouple TC. In practice, the thermocouple can be disposed near the nozzle 18 and acts as the temperature sensor 410 in FIG. 4. When the temperature of the nozzle 18 increases, the voltage $V_T$ produced by the thermocouple increases. Conversely, when the temperature of the nozzle 18 decreases, the voltage $V_T$ produced by the thermocouple reduces. Thus, the voltage $V_T$ can be regarded as the measured temperature signal 580. Accordingly, the measured temperature signal 580 is produced according to the temperature of the nozzle. Since the structure of the detection gate 619 in FIG. 8B is similar to that in FIG. 8A, the details will not be described for the sake of brevity.

Figure 9B:
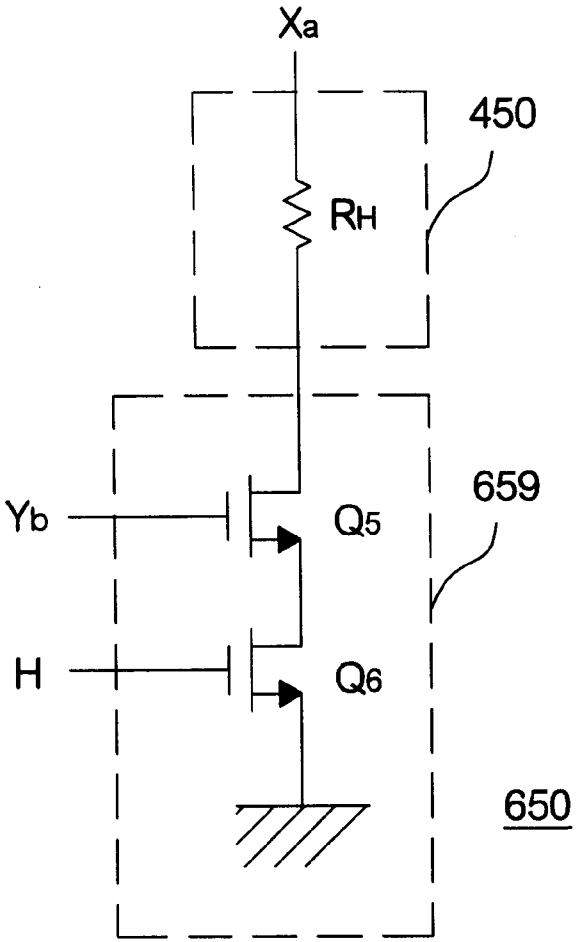
FIG. 9B is a circuit diagram of another example of the heating module in FIG. 6.
Figure 9A:
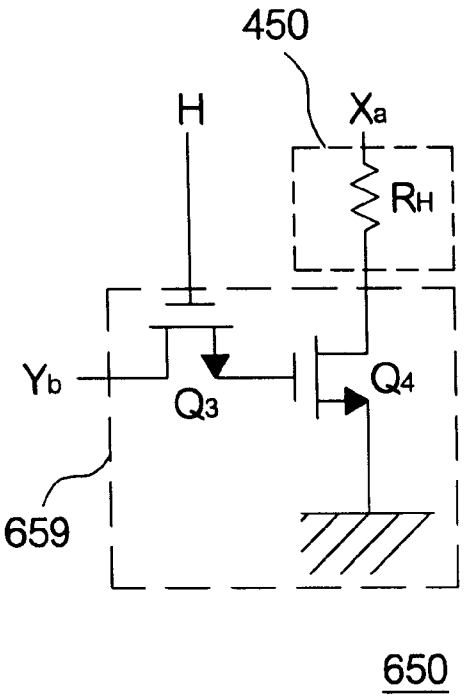
FIG. 9A is a circuit diagram of an example of the heating module in FIG. 6.

Referring to FIG. 9A, it shows a circuit diagram of an example of the heating module 650 in FIG. 6, wherein the heating module 650 includes an enabling gate 659 and a heating device 450. In practice, a resistor $R_H$ can be used as the heating device 450, disposed near the nozzle 18 to heat the ink, and coupled to the row selection signal $X_a$. The enabling gate 659 is formed by coupling the source of a transistors $Q_3$ with the gate of another transistor $Q_4$. The enabling gate 659 is then coupled with the heating device 450 so as to selectively enable the heating device 450 to heat. In practice, the transistor $Q_3$ can be coupled with the column selection signal $Y_b$ and the enabling signal H while the transistor $Q_4$ can be coupled with the heating device 450. If the row and column selection signals $X_a$ and $Y_b$ are active and fed into the heating module 650 while the enabling signal H is not, the heating device 450 will not be enabled because both the transistors $Q_3$ and $Q_4$ are off. If all the enabling signal H, the row and column selection signals $X_a$ and $Y_b$ are active and fed into the heating module 650, the heating device 450 will be enabled and heats up because both the transistors $Q_3$ and $Q_4$ are on. Thus, it shows that the heating module 650 controls the heating device 450 so that the heating device 450 heats up according to the enabling signal H, the row and column selection signals $X_a$ and $Y_b$. In addition, there are other possible implementations for the heating module 560 and one of them is described along with FIG. 9B as follows.

FIG. 9B is a circuit diagram of another example of the heating module 650 in FIG. 6, wherein the heating module 650 includes an enabling gate 659 and a heating device 450. Compared with the enabling gate in FIG. 9A, the enabling gate in FIG. 9B is formed by connecting the source of a transistor $Q_5$ with the drain of another transistor $Q_6$. In addition, the gate of the transistor $Q_5$ is coupled to the column selection signal $Y_b$ while the gate of the transistor $Q_6$ is coupled to the enabling signal H. As can be observed from FIG. 9B, this structure performs the function identical to that in FIG. 9A. It should be noticed that though in this embodiment the heating device 450 heats up only when all the enabling signal H, the row and column selection signals $X_a$ and $Y_b$ are active and inputted into the heating module 650, the way the three signals are set to active and fed into the heating module may be implemented differently. Other ways of feeding the three signals into the heating module, such as changing the transistors arrangement and the feeding points of the three signals, may also lead to the same result.

EXAMPLE II

Figure 10:
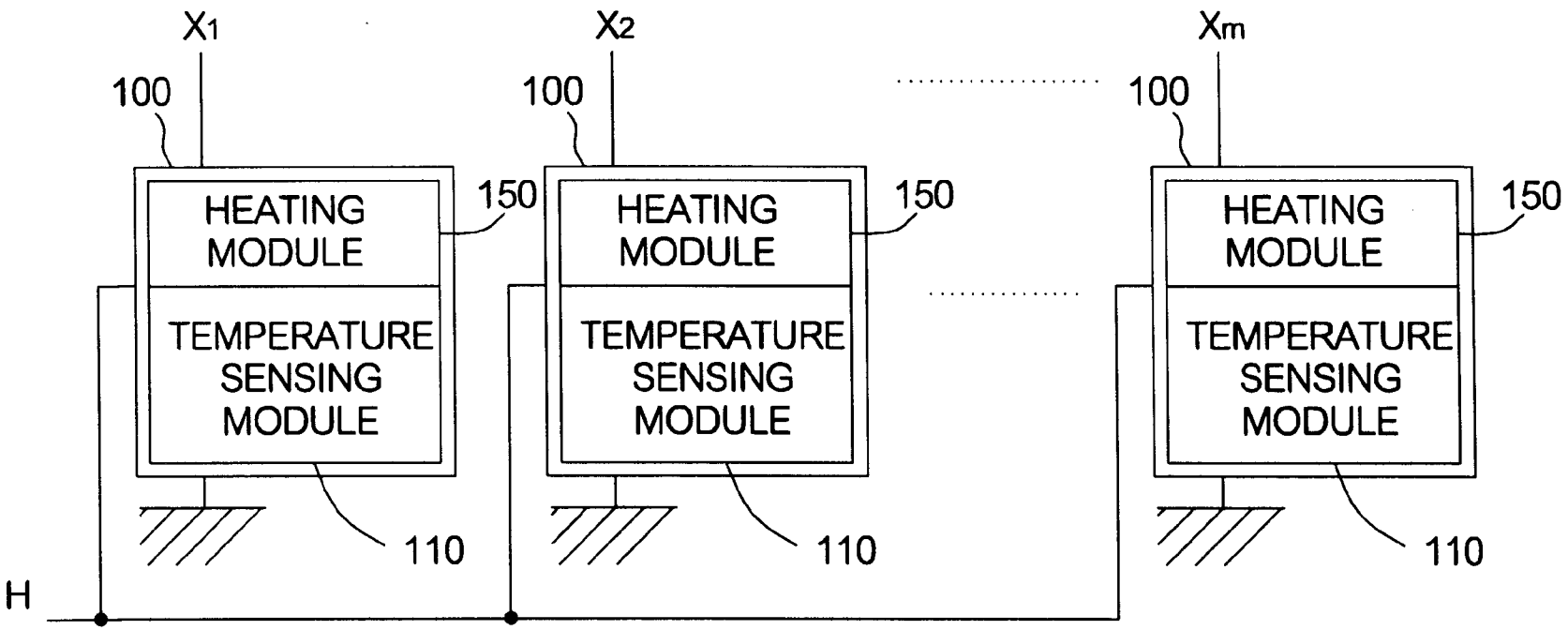
FIG. 10 is a circuit diagram of a linear array of ink ejectors.

Referring to FIG. 10, it shows a block diagram illustrating the control of a linear array of ink ejector including m ink ejector circuits 100. Each of the ink ejector circuits 100, capable of temperature sensing, is controlled by a selection signal $X_k$ and an enabling signal H, where k is an integer equal to 1, 2, 3, . . . to m. When only the selection signal $X_k$ is active and fed into the heating device 100 but the enabling signal H is not, a measured temperature signal indicative of the temperature of the nozzle which is associated with the selection signal $X_k$ is outputted. When both the selection signal $X_k$ and the enabling signal H are active and fed into the heating device 100, the nozzle associated with the selection signal $X_k$ is selected to eject ink droplets. Since the operation is in the same way as in example I, the details will not be described for brevity.

Figure 11:
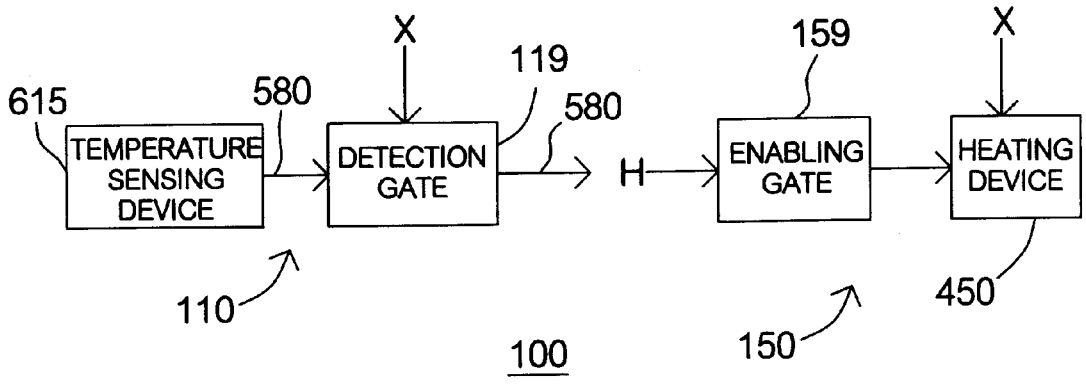
FIG. 11 is a block diagram of the ink ejector circuit in FIG. 10.

Referring to FIG. 11, it shows a block diagram illustrating the ink ejector circuit in FIG. 10. The ink ejector circuit 100 includes a temperature sensing module 110 and a heating module 150. Both the temperature sensing module 110 and the heating module 150 are coupled to the selection signal X. Besides, the heating module 150 is further coupled to the enabling signal H so that the heating module 650 will not erroneously be driven to eject ink drops while temperature measuring is performed.

Figure 12A:
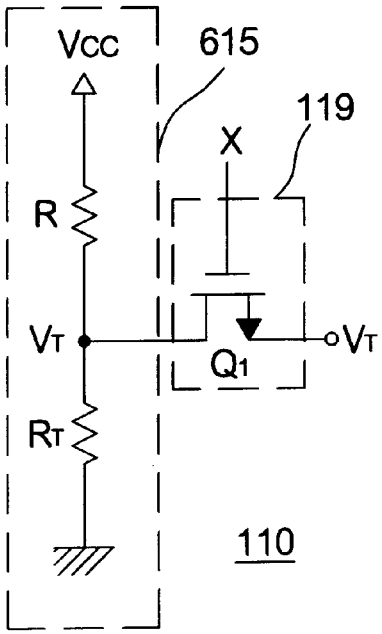
FIG. 12A is a circuit diagram of an example of the temperature sensing module in FIG. 11.

FIG. 12A is a circuit diagram illustrating the temperature sensing module 110 in FIG. 11. Since only one dedicated selection signal is applied to the temperature sensing module 110, the detection gate 119 of the temperature sensing module 110 can be implemented by a transistor $Q_1$. In practice, the transistor $Q_1$ can be coupled with to the temperature sensing device 615 as shown in FIG. 12A, where the selection signal X is coupled with the gate of the transistor $Q_1$. When the selection signal X is active and fed into the transistor $Q_1$ to turn on the transistor $Q_1$, the measured temperature signal 580, that is, voltage $V_T$, is outputted and the temperature of the nozzle is then obtained via the measured temperature signal 580. Since the operation of the temperature sensing device 615 in FIG. 12A is identical to that in example I so the detailed operation will not be described for brevity.

Figure 12B:
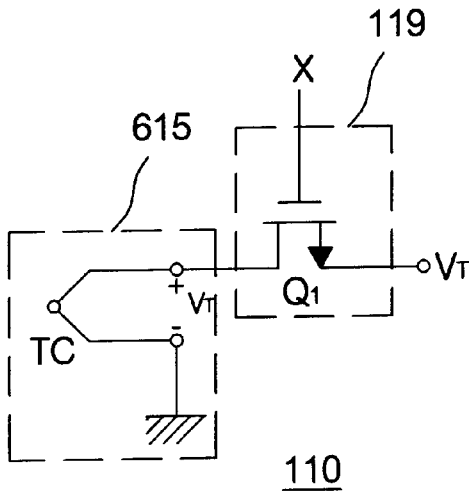
FIG. 12B is a circuit diagram of another example of the temperature sensing module in FIG. 11.

Referring to FIG. 12B, it is a circuit diagram showing another example of the temperature sensing module 110 in FIG. 11, wherein the temperature sensing device 615 is implemented by a thermocouple TC. Similar to the temperature sensing device 615 in FIG. 12A, the thermocouple TC is coupled to the transistor $Q_1$ which acts as the detection gate 119. When the selection signal X is active and fed into the detection gate 119, the measured temperature signal 580, that is, the voltage $V_T$, is outputted and the temperature of the nozzle is then obtained via the measured temperature signal 580. Since the operation with the thermocouple in FIG. 12B is identical to that described in example I so the operation with thermocouple in FIG. 12B will not be described for the sake of brevity.

Figure 13:
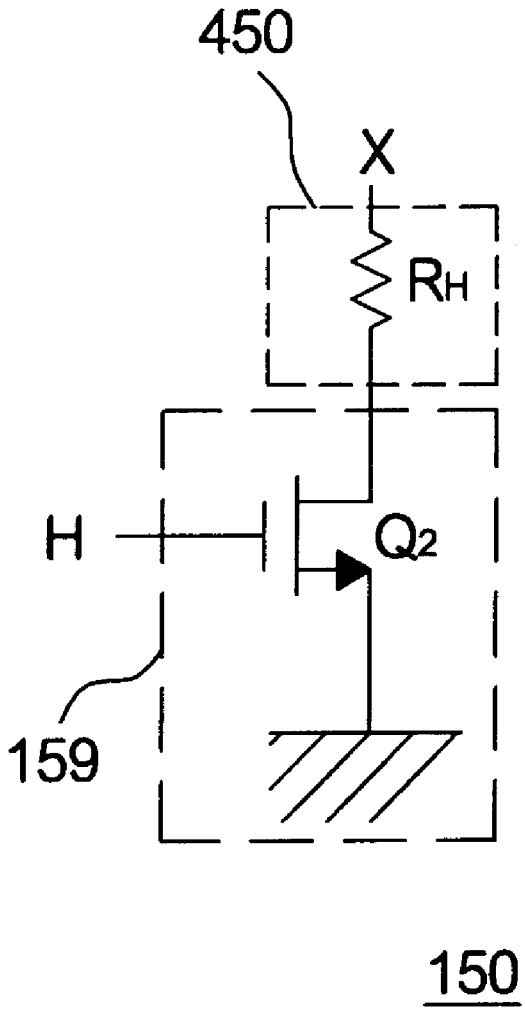
FIG. 13 is a circuit diagram illustrating the heating module in FIG. 11.

Referring now to FIG. 13, it shows a circuit diagram of the heating module 150 in FIG. 11, wherein the heating module 150 includes an enabling gate 159 and the heating device 450. In practice, the heating device 450 can be implemented by a resistor $R_H$ which is disposed near the nozzle 18 and is coupled with the selection signal X. In addition, since the selection signal X is an independent signal, it is adequate to use a transistor Q as the enabling gate 159. When both the selection signal X and the enabling signal H are active and fed into the heating module 150, the heating device 450 heats up.

It should be noted that, in the preferred embodiments of the invention, the detection gates and the enabling gates are formed by metal oxide semiconductor field effect transistor (MOSFET). However, MOSFET is not the only circuit element available to form the gates; other transistors. Other components, such as bipolar junction transistors (BJT) or junction field effect transistors (JFET), can also be used to serve as the gates without departing the principle of the invention. In addition, the ways of signal feeding in the embodiments are taken as examples only and do not give limitations to the invention. People skilled in the art may also modify the signal feeding terminals to achieve the same purpose without departing the principle of the invention. In addition to inkjet printers, the inventions may also apply to other office machines equipped with inkjet print heads, such as facsimile machines, and multi-purpose functional office machines.

As disclosed above, the print head apparatus according to the invention has a major advantage that the temperatures of all of the nozzles can be selectively measured and obtained. Since the detailed temperature information of the ink ejectors are obtainable, further action to control the ink ejectors, such as temperature control, can be performed based on the temperature information. As compared with the conventional technique that provides only an average temperature of print head, the invention can provide the temperature information of the nozzles selectively. Thus, the print head apparatus can be used to provide detailed and complete temperature information for use in further temperature control for improving the quality of printing.

While the invention has been described by way of example and in terms of the preferred embodiment, it is to be understood that the invention is not limited to the disclosed embodiment. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A print head apparatus capable of temperature sensing, the print head apparatus comprising:

an ink ejector, coupled to an enabling signal and a selection signal comprising first and a second signals for selecting the ink ejector, the ink ejector comprising:

a nozzle;

a heating module for selectively heating ink in the ink ejector so that ink droplets are ejected from the nozzle, the heating module comprising:

a heating device, disposed in close proximity to the nozzle and coupled to the first signal, for heating up the ink in the ink ejector so that ink droplets are ejected from the nozzle; and an enabling gate coupled to the second signal, an enabling signal, and the heating device, for selectively transmitting the second signal to the heating module so that the heating device heats up; and a temperature sensing module for selectively producing a measured temperature signal indicative of a temperature of the ink in close proximity to the nozzle, the temperature sensing module comprising:

a temperature sensor, disposed in close proximity to the nozzle, for measuring the temperature of the ink in close proximity to the nozzle and producing the measured temperature signal indicative of the temperature of the ink in close proximity to the nozzle; and a detection gate, coupled to the temperature sensor and the selection signal, for selectively outputting the measured temperature signal, the detection gate comprising:

a first transistor coupled to the first signal; and a second transistor, coupled to the first transistor and the second signal;

wherein when the enabling signal is active, and the selection signal is active and indicates that the ink ejector is selected, the enabling gate transmits the second signal to the heating module so that the heating device heats up;

wherein when the selection signal is active and indicates that the ink ejector is selected, the detection gate outputs the measured temperature signal.

2. A print head apparatus according to claim 1, wherein the temperature sensor is a thermistor.

3. A print head apparatus according to claim 1, wherein the temperature sensor is a thermocouple.

4. A print head apparatus according to claim 1, wherein the measured temperature signal is a voltage signal.

5. A print head apparatus according to claim 1, wherein the first transistor and the second transistor are metal oxide semiconductor field effect transistors.

6. A print head apparatus according to claim 1, wherein the first transistor and the second transistor are junction field effect transistors.

7. A print head apparatus according to claim 1, wherein the first transistor and the second transistor are bipolar junction transistors.

8. A print head apparatus according to claim 1, wherein the heating device is a resistor.

9. A print head apparatus according to claim 1, wherein the enabling gate comprises a first transistor and a second transistor, the first transistor is coupled to the second transistor, the first transistor is coupled to the second signal, and the second transistor is coupled to the enabling signal.

10. A print head apparatus according to claim 9, wherein the first transistor and the second transistor are metal oxide semiconductor field effect transistors.

11. A print head apparatus according to claim 9, wherein the first transistor and the second transistor are junction field effect transistors.

12. A print head apparatus according to claim 9, wherein the first transistor and the second transistor are bipolar junction transistors.

13. A print head apparatus capable of temperature sensing, the print head apparatus comprising:

an ink ejector, coupled to an enabling signal and a selection signal for selecting the ink ejector, the ink ejector comprising:

a nozzle;

a heating module for selectively heating ink in the ink ejector so that ink droplets are ejected from the nozzle, the heating module comprising:

a heating device, disposed in close proximity to the nozzle and coupled to the selection signal, for heating up the ink in the ink ejector so that ink droplets are ejected from the nozzle; and an enabling gate coupled to the enabling signal and the heating device, for selectively activating the heating device; and a temperature sensing module for selectively producing a measured temperature signal indicative of a temperature of the ink in close proximity to the nozzle, the temperature sensing module comprising:

a temperature sensor, disposed in close proximity to the nozzle, for measuring the temperature of the ink in close proximity to the nozzle and producing the measured temperature signal indicative of the temperature of the ink in close proximity to the nozzle; and a detection gate, coupled to the temperature sensor and the selection signal, for selectively outputting the measured temperature signal, the detection gate comprising:

a first transistor coupled to the selection signal; and a second transistor, coupled to the first transistor and the selection signal;

wherein when the enabling signal is active, and the selection signal is active and indicates that the ink ejector is selected, the enabling gate activates the heating module so that the heating device heats up;

wherein when the selection signal is active and indicates that the ink ejector is selected, the detection gate outputs the measured temperature signal.

14. A print head apparatus according to claim 13, wherein the temperature sensor is a thermal resistor.

15. A print head apparatus according to claim 13, wherein the temperature sensor is a thermocouple.

16. A print head apparatus according to claim 13, wherein the measured temperature signal is a voltage signal.

17. A print head apparatus according to claim 13, wherein the detection gate is a transistor.

18. A print head apparatus according to claim 17, wherein the transistor is a metal oxide semiconductor field effect transistor.

19. A print head apparatus according to claim 17, wherein the transistor is a junction field effect transistor.

20. A print head apparatus according to claim 17, wherein the transistor is a bipolar junction transistor.

21. A print head apparatus according to claim 13, wherein the heating device is a resistor.

22. A print head apparatus according to claim 13, wherein the enabling gate is a transistor.

23. A print head apparatus according to claim 22, wherein the transistor is a metal oxide semiconductor field effect transistor.

24. A print head apparatus according to claim 22, wherein the transistor is a junction field effect transistor.

25. A print head apparatus according to claim 22, wherein the transistor is a bipolar junction transistor.

26. A print head apparatus capable of temperature sensing, the print head apparatus comprising an ink ejector, coupled to an enabling signal and a selection signal including first and a second signals for selecting the ink ejector, the ink ejector comprising:

a nozzle;

a heating module for selectively heating ink in the ink ejector so that ink droplets are ejected from the nozzle; and a temperature sensing module for selectively producing a measured temperature signal indicative of a temperature of the ink in close proximity to the nozzle, the temperature sensing module comprising:

a temperature sensor, disposed in close proximity to the nozzle, for measuring the temperature of the ink in close proximity to the nozzle and producing the measured temperature signal indicative of the temperature of the ink in close proximity to the nozzle; and a detection gate, coupled to the temperature sensor and the selection signal, for selectively outputting the measured temperature signal, the detection gate comprising:

a first transistor coupled to the first signal; and a second transistor, coupled to the first transistor and the second signal;

wherein when the enabling signal is active, and the selection signal is active and indicates that the ink ejector is selected, the heating module is activated so that ink droplets are ejected from the nozzle;

wherein when the selection signal is active and indicates that the ink ejector is selected, the temperature sensing module outputs the measured temperature signal indicative of the temperature of the ink in close proximity to the nozzle.

27. A print head apparatus according to claim 26, wherein the heating module comprises:

a heating device, disposed in close proximity to the nozzle, for heating up the ink in the ink ejector so that ink droplets are ejected from the nozzle; and an enabling gate, coupled to the selection signal and the enabling signal, for activating the heating device so that the nozzle ejects ink droplets when the enabling signal is active and the selection signal is active and indicates that the ink ejector is selected.

28. A method for temperature measurement in a print head apparatus including a plurality of ink ejectors, the method being capable of avoiding erroneously driving the ink ejectors when performing temperature measurement, wherein each ink ejector includes a nozzle, a heating module, and a temperature sensing module, the heating module includes a heating device and an enabling gate, the temperature sensing module includes a temperature sensor and a detection gate, the method comprising the steps of:

selectively applying a plurality of selection signals that are active to the ink ejectors;

disabling the heating modules of the selected ink ejectors so as to stop ink droplets to be ejected from the nozzles of the selected ink ejectors by applying an enabling signal that is not active to the heating modules of the selected ink ejectors, and outputting at least one measured temperature signal indicative of the temperature of ink in close proximity to the nozzle of a corresponding selected ink ejector by the temperature sensing module of the corresponding selected ink ejector, if temperature measurement is desired and ink ejection is not desired; and enabling the heating modules of the selected ink ejectors so as to eject ink droplets from the nozzles of the selected ink ejectors by applying the enabling signal that is active to the heating modules of the selected ink ejectors if ink ejection is desired;

wherein in the step of disabling the heating modules, each selection signal includes a first signal and a second signal, each heating module of the corresponding selected ink ejector is disabled by using the corresponding enabling gate having a first transistor and a second transistor coupled to the first transistor, and the enabling signal that is not active is applied to the second transistor of the corresponding enabling gate to disable the corresponding heating device, thereby avoiding erroneously driving the ink ejectors when performing temperature measurement.

29. A method for temperature measurement in a print head apparatus including a plurality of ink ejectors, the method being capable of avoiding erroneously driving the ink ejectors when performing temperature measurement, wherein each ink ejector includes a nozzle, a heating module, and a temperature sensing module, the heating module includes a heating device and an enabling gate, the temperature sensing module includes a temperature sensor and a detection gate, the method comprising the steps of:

selectively applying a plurality of selection signals that are active to the ink ejectors;

disabling the heating modules of the selected ink ejectors so as to stop ink droplets to be ejected from the nozzles of the selected ink ejectors by applying an enabling signal that is not active to the heating modules of the selected ink ejectors, and outputting at least one measured temperature signal indicative of the temperature of ink in close proximity to the nozzle of a corresponding selected ink ejector by the temperature sensing module of the corresponding selected ink ejector, if temperature measurement is desired and ink ejection is not desired; and enabling the heating modules of the selected ink ejectors so as to eject ink droplets from the nozzles of the selected ink ejectors by applying the enabling signal that is active to the heating modules of the selected ink ejectors if ink ejection is desired;

wherein in the step of disabling the heating modules, each selection signal has a first signal and a second signal, said at least one measured temperature signal indicative of the temperature of ink in close proximity to the nozzle of the corresponding selected ink ejector is outputted by the corresponding temperature sensor via the corresponding detection gate having a first transistor and a second transistor coupled to the first transistor, the first and the second signals are applied to the first and the second transistors respectively.

* * * * *